United States Patent [19]

Hirano

[11] Patent Number: 4,519,221

[45] Date of Patent: May 28, 1985

[54] KNITTING MACHINE

[75] Inventor: Hideo Hirano, Nara, Japan

[73] Assignee: Okamoto & Co., Ltd., Nara, Japan

[21] Appl. No.: 531,176

[22] Filed: Sep. 8, 1983

[30] Foreign Application Priority Data

Sep. 8, 1982 [JP] Japan ..... 57-157293
Jul. 13, 1983 [JP] Japan ..... 57-108566
Jul. 14, 1983 [JP] Japan ..... 58-129100

[51] Int. Cl.[3] ..... D04B 15/06; D04B 9/12

[52] U.S. Cl. ..... 66/107; 66/217; 66/93

[58] Field of Search ..... 66/104, 107, 108 R, 66/108 A, 137, 216, 217, 93

[56] References Cited

U.S. PATENT DOCUMENTS 1,678,386 7/1928 Grothey ..... 66/217
1,699,321 1/1929 Wildt et al. ..... 66/108 R
2,101,005 11/1937 Lawson ..... 66/108 R X
2,134,480 10/1938 Houseman ..... 66/217
2,703,970 3/1955 Reymes-Cole et al. ..... 66/108 R X
3,877,258 4/1975 Uhlir ..... 66/107 X

FOREIGN PATENT DOCUMENTS 519342 1/1921 France ..... 66/104

*Primary Examiner*—Wm. Carter Reynolds
*Attorney, Agent, or Firm*—Koda and Androlia

[57] ABSTRACT

A circular knitting machine includes a cylinder spacedly provided with vertical slits on its overall circumference, and sinkers and knitting needles alternately mounted in every other slit of the cylinder. Each one of the sinkers is formed on its bottom side with a cutout so that a sinker selection jack moving up and down within the slit pushes the slant front edge of the cutout to move the sinker horizontally, or towards the center of the cylinder. With the structure, the movements of the sinker can be individually controlled to form a pile patterning and reversed patterning.

1 Claim, 14 Drawing Figures

KNITTING MACHINE

BACKGROUND OF THE INVENTION

1. Field of the Invention

The present invention relates to a knitting machine, and more particularly to a structure of a sinker and sinker cylinder for a knitting machine.

2. Prior Art

FIG. 1 shows a tooth butt sinker (a sinker provided with tooth butts) in the prior art. In a conventional knitting machine, a sinker 1 is selectively moved in the direction of arrow b by a selector finger 5 which pushes the tooth butt 1*a* in the direction of arrow a.

This structure, however, is disadvantageous in that since the teeth of the butts 1*a* cannot be increased in number, the variation of the intended pattern is limited. Also, since the tooth butt 1*a* is formed on the sinker 1, the mechanical strength of the sinker is not sufficient, requiring relatively lower rotational frequency of the knitting machine compared to the ordinary sinkers having no tooth butts.

SUMMARY OF THE INVENTION

The object of the present invention is, therefore, to obviate the disadvantages in the conventional knitting machine and to provide an improved structure for the sinker and cylinder therefore wherein the selective movement of the sinkers in a horizontal direction is actuated by a simple mechanism.

In keeping with the principles of the invention, the objects of the invention are accomplished by a unique structure for a sinker and cylinder therefor in a knitting machine wherein the bottom side of a sinker is formed with a cutout and a sinker selector jack is inserted in a cylinder slit sharing the same operational phase space with the sinker. The selector jack is driven to move upward so that the head of the sinker selector jack pushes the sloped front edge of the cutout of the sinker to move it towards the center of the cylinder horizontally for performing the positional selection for the sinker patterning.

DETAILED DESCRIPTION OF THE INVENTION

Figure 1:
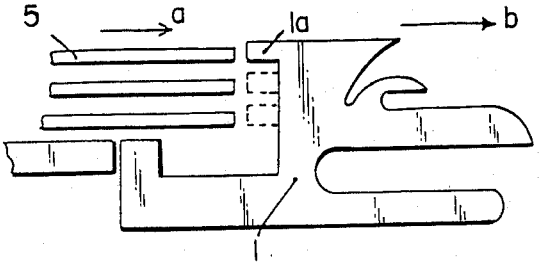
Fig. 1 PRIOR ART
FIG. 1 is a front view of a sinker in the prior art.
Figure 2:
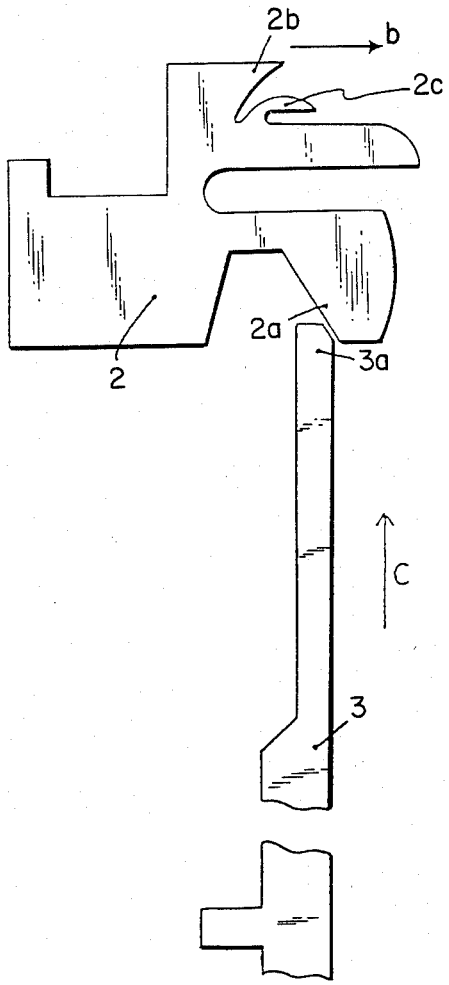
FIG. 2 is a front view showing the movements of a sinker and a sinker selector jack in accordance with the teachings of this invention.

FIG. 2 shows the principles of the present invention. The bottom side of a sinker 2 is formed with a cutout having slant front edge 2*a*. A sinker selector jack 3 is disposed below the slant front edge 2*a* of the sinker 2 and moves upward in the direction of an arrow c to act with its jack head 3*a* onto the front edge 2*a* of the sinker 2. As a result, the sinker 2 is caused to move horizontally in the direction of an arrow b, or towards the center of a cylinder which will be described later.

Figure 3:
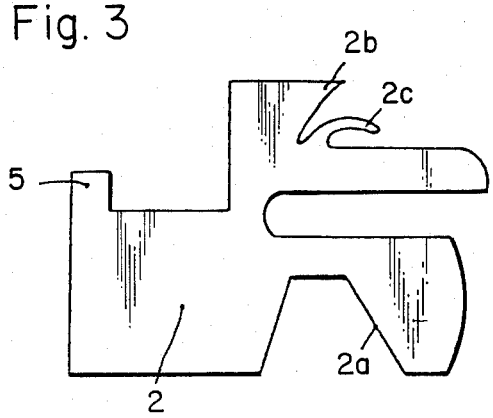
FIG. 3 is a front view of a sinker of this invention.

Referring to FIG. 3, it is a front view of the sinker according to the present invention. The bottom side of the sinker 2 is cut out to form the slant front edge 2*a*. A sinker hook 2*c* and a pile (terry) hook 2*b*, both being the knitting points of the sinker 2, can be in various forms. Thus, the sinker according to the present invention has the cutout with the slant front edge 2*a* which elongates the total length of the bottom side of the sinker.

Figure 4:
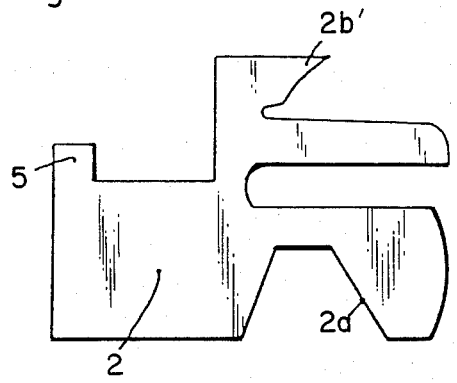
FIG. 4 is a front view of a sinker having a different shape from that of FIG. 3.

FIG. 4 shows another sinker having a different shape to that of FIG. 3. The sinker of FIG. 4 does not include the sinker hook 2*c* but is provided with the terry hook 2*b'* only. The bottom side of the sinker is also formed with a cutout having the slant front edge 2*a*.

Figure 5:
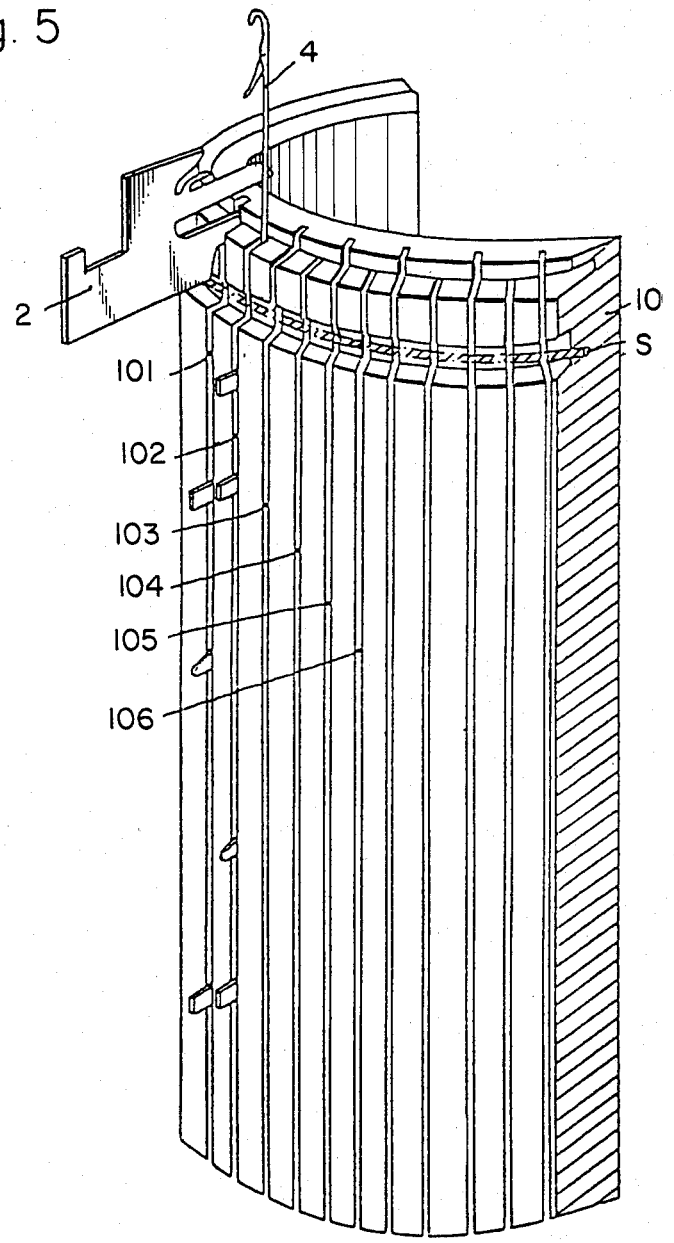
FIG. 5 is a partially perspective view of a cylinder.

FIG. 5 shows a schematic view of a part of a cylinder 10 in accordance with the present invention, wherein the positional relation between a knitting needle 4 and sinker 2 is illustrated. The cylinder 10 is spacedly provided with vertical slits 101, 102, 103 . . . on its entire circumference. In a slit 101 which is below the sinker 2 is inserted a sinker selector jack 3. A needle selector jack 40 is inserted in a slit 102 which is below the needle 4. The slits 101, 103, 105, . . . (labeled with odd numbers) house the sinker selector jacks 3 in them, while the slits 102, 104, 106, . . . (labeled with even numbers) house the needles 4 and needle selector jacks 40 in them, respectively. In the drawing, for the sake of simplification, only one pair of needle 4 and sinker 2 is shown, but in real situation, the same pairs are housed in alternate respective slits so that the sinker 2 is disposed radially from the axis of the cylinder 10. The knitting needles 4 and the sinker selector jacks 3 are held by a spring S to prevent them from popping out.

Figure 6:
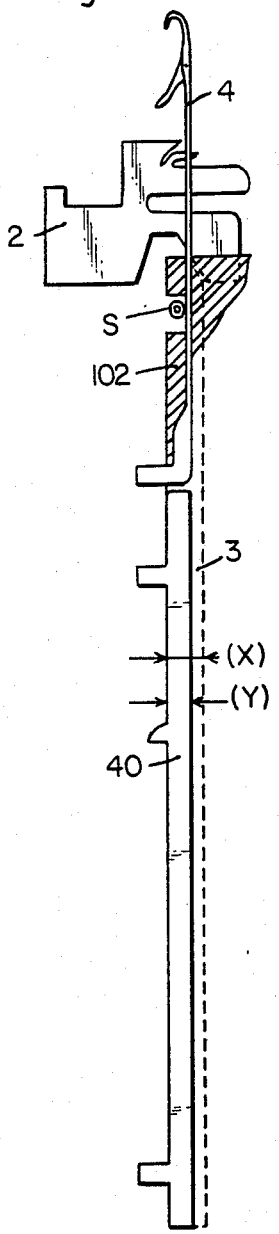
FIG. 6 is a front view showing the positional relation between a sinker and a knitting needle.

FIG. 6 is a front view showing the positional relation between the needle 4, the sinker 2, and the needle selector jack 40.

The width x of the sinker selector jack 3 is different from the width y of the needle selector jack 40. Therefore, the slits 101, 103, 105, . . . for housing the sinker selector jacks 3 are cut to be x in depth, while the slits 102, 104, 106, . . . for housing the needle selector jacks 40 are cut to be y in depth, so that the side surfaces of the sinker selector jacks 3 and the needle selector jacks 40 do not project out of the cylinder circumference.

Figure 7:
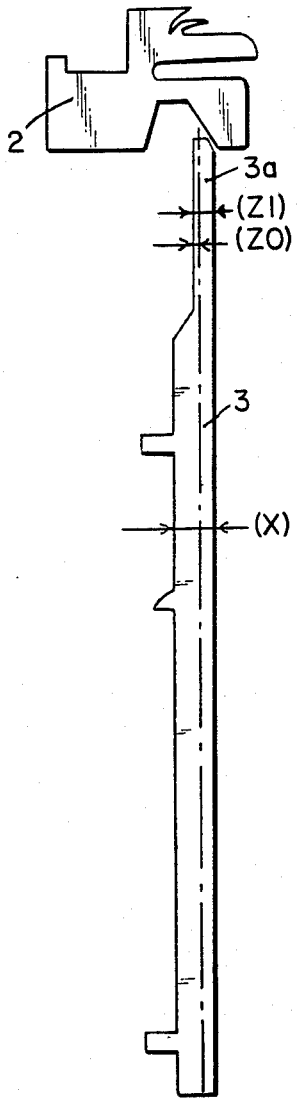
FIG. 7 is a front view showing the positional relation between the sinker and a sinker selector jack.
Figure 8:
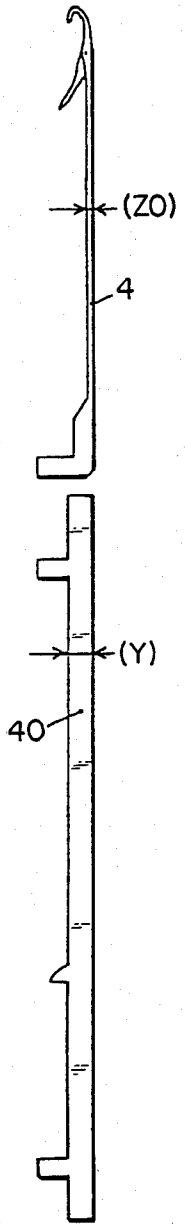
FIG. 8 is a front view illustrating the positional relation between the knitting needle and needle selector jack.

FIG. 7 shows the positional relation between the sinker 2 and the sinker selector jack 3. FIG. 8 shows the positional relation between the needle 4 and the needle selector jack 40. When considering strength, the width Z1 of the jack head 3*a* must be made wider than the width Z0 of the needle 4. Consequently, in order to bring the needle surface and the surface of the jack head 3*a* to be level with each other on the outer surface of the cylinder, the slits 101, 103, 105, . . . for the sinker selector jacks 3 must be set deeper by Z1–Z0 than the slits 102, 104, 106, . . . for the needle selector jacks 40.

As has been described above, in the present invention, for performing the sinker patterning, the cylinder 10 is provided with twice as many slits as needles. Furthermore, the slits for the sinker selector jacks 40 are formed more than 1 mm deeper than the slits for the needle selector jacks 40, respectively, so that the side surfaces of the needle and the jack head are level with each other in terms of the extent of their protrusion on the cylinder surface. With this arrangement, the jack head 3*a* is given sufficient strength for thrusting up the sinker 2, thereby facilitating the driving operation.

In the drawings, though the side views of the sinker and the knitting needle are not shown, the thickness of the sinker and the knitting needle is usually 0.2–2.0 mm, respectively.

Figure 9:
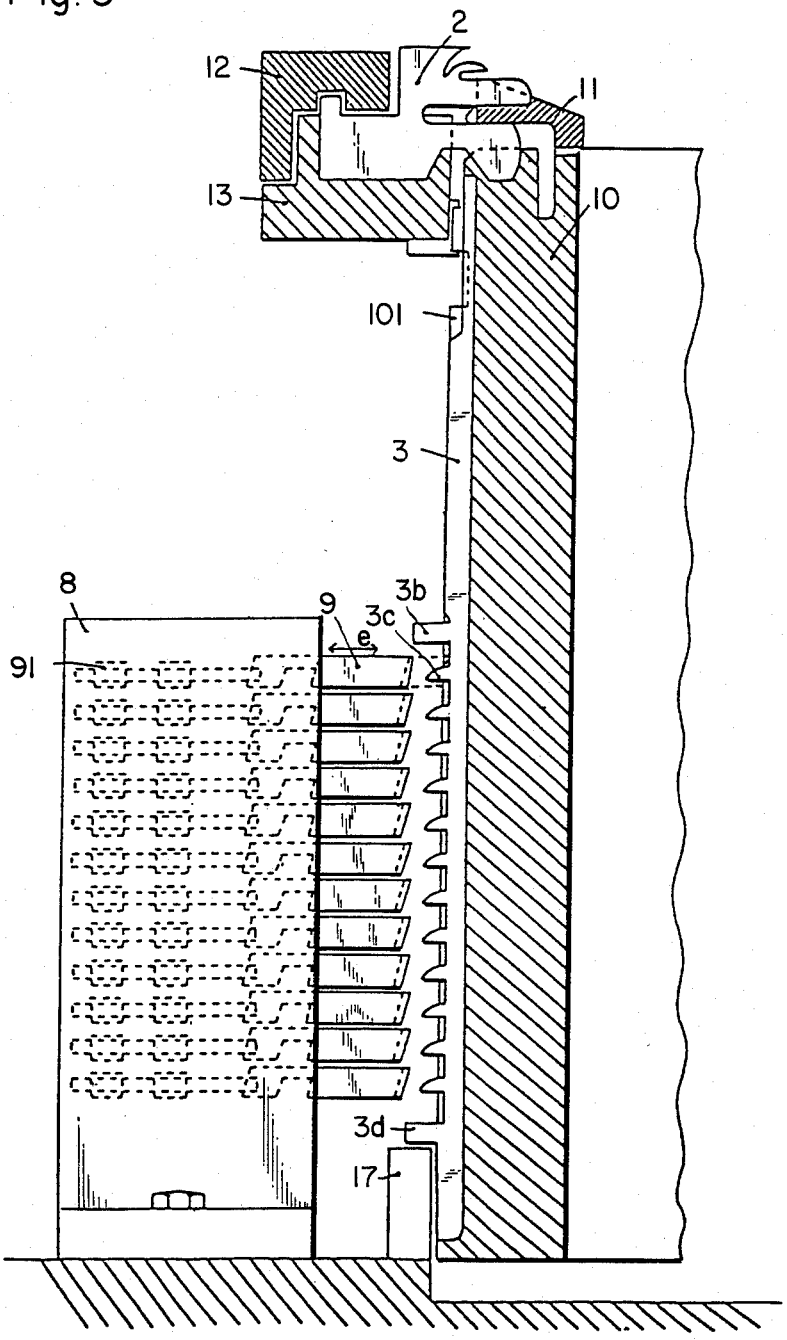
FIG. 9 is a vertical section showing the cylinder with the sinker and solenoid actuator.

FIG. 9 is a cross-sectional view of the cylinder 10. In a slit 101 of the cylinder 10, there is inserted the sinker selector jack 3. The sinker selector jack 3 is provided with a butt 3*b* (top butt) and selector butts (jack butts) 3*c* in a number of more than ten. These selector butts 3*c* are selectively driven to go up by means of selector fingers 9 of a conventional type needle selecting solenoid actuator 8 for performing selective patterning of the sinkers. It is designed such that all but one selector butt 3*c* are left out, and the remaining selector butt 3*c* is acted upon by the selector finger 9 that corresponds to the selected selector butt 3*c*. The selector finger 9 moves in and out in the direction shown by the arrow e by being energized by the pulse current applied to solenoid 91. The sinker 2 is inserted in the slit formed between an inner sinker ring 11 and an outer sinker ring 13. Since the sinker 2 is blocked by a sinker cap 12 and the inner sinker ring 12 is held by the undersurfaces of these component members, the sinker 2 is prevented from moving up when the sinker selector jack 3 gives an upward thrust to it and moves in the horizontal direction, or towards the center of the cylinder 10, as described with respect to FIG. 2.

Figure 10:
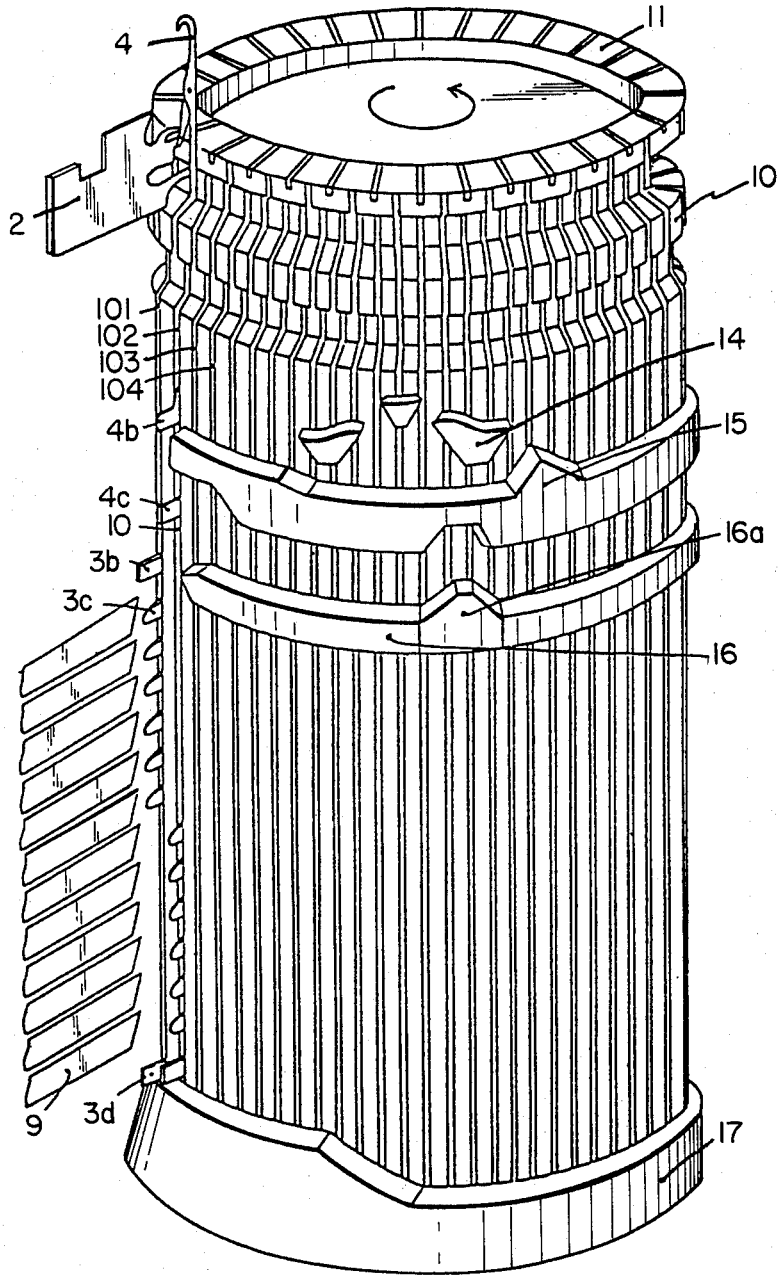
FIG. 10 is a schematic view of the cylinder.

FIG. 10 shows a schematic view of the cylinder in accordance with the present invention. The (top) butt 3*b* of the sinker selector jack 3, selectively actuated by means of the selector finger 9, engaging the selector butts 3*c*, passes along the uppersurface of a guide cam 16, and it is pressed upward by a cam (jack operating cam) 16*a*, at the knitting position. The butt 3*b* of the sinker selector jack 3 that is not actuated passes through under the guide cam 16; therefore, the selector jack does not receive the upward thrust at the knitting position. The needle 4 is moved downward by a stitch cam 14 and performs the knitting action. By dividing the teeth of the selector butts 3*c* into the upper half group to function as the sinker selector butts and the lower half group to function as the sinker selector butts, the needle paterning that has been conventionally performed by needle selection can be done at the same time.

As should be apparent from the foregoing description, in the present invention, when the number of the needles used in a knitting machine is N, the required number of the cylinder slits of that particular knitting machine shall be 2N. The needle selector jacks and the sinker selector jacks are inserted alternately in the slits, and the needle selection can be done simultaneously with the sinker selection. As a method to give the instructions for patterning, either the conventional mechanical pin drum or the computerized patterning system with microcomputers and an actuator may be used.

In FIG. 10, a jack leveling cam 17 is a cam for setting the height level of the jack butt (bottom butt) 3*d*. The cylinder 10 rotates in the direction of an arrow f.

Figure 11A:
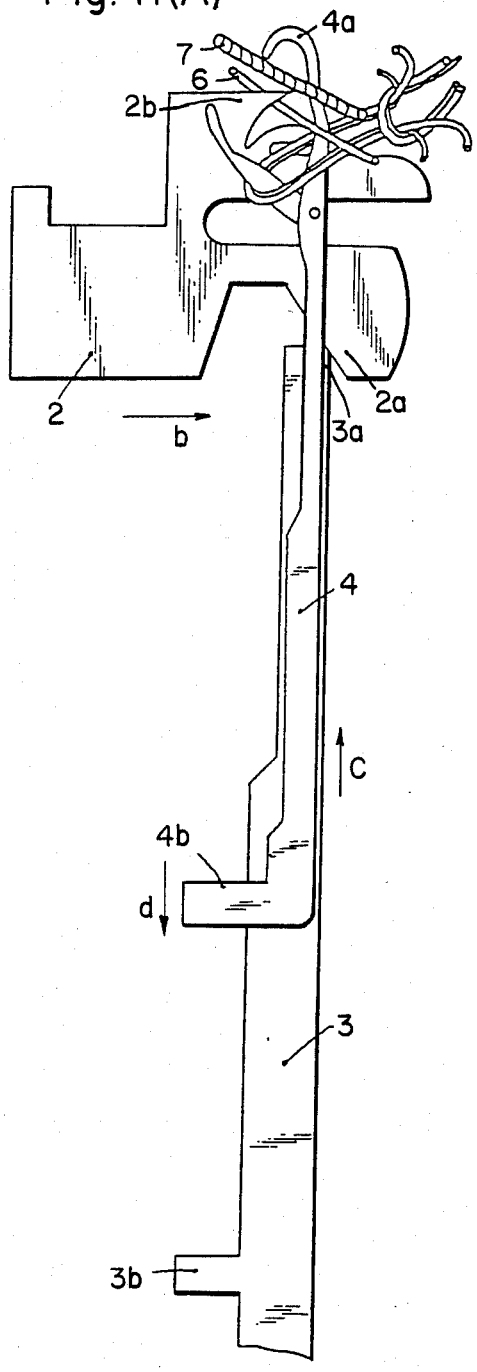
FIGS. 11(A) and (B) show the operational principles according to the present invention, with illustration of the positional relation between the sinker, the sinker selector jack, and a needle.

FIGS. 11(A) and (B) show schematic views illustrating the knitting actions of the sinker 2, the sinker selector jack 3, and the knitting needle 4 during the pile (terry) patterning in accordance with the principles of the present invention.

FIG. 11(A) shows the state wherein a portion of ground yarn 6 and a portion of terry yarn 7 are fed to the needle 4. When the sinker selector jack 3 moves up (arrow c), the sinker 2 is moved in the arrow b direction thereby in turn causing the terry yarn 7 to come to be held on a terry hook 2*b* of the sinker 2.

Figure 11B:
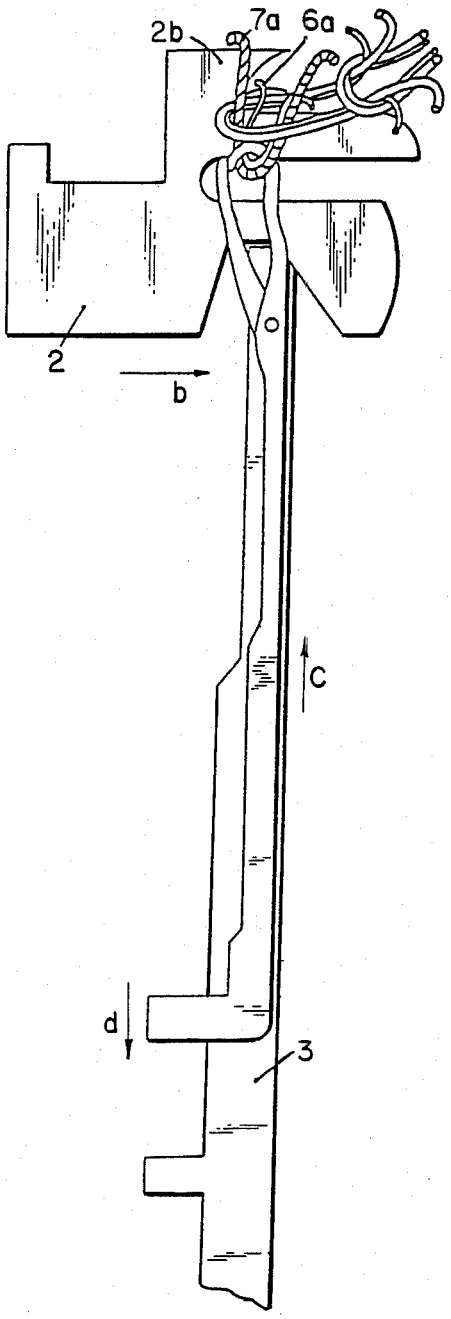

In the state shown in FIG. 11(B), the needle 4 goes down in the direction of arrow d to form a stitch. At this point, the sinker selector jack 3 is at the uppermost level, and the sinker 2 is brought to take the piling position. In this state, the terry yarn 7 is held on the terry hook 2*b* and forms a long sinker loop 7*a*, while the ground yarn 6 is held on the sinker hook 2*c* of the sinker 2 and forms an ordinary short sinker loop 6*a*.

If the sinker selector jack 3 is not driven to go up, the knitting stitch is formed with the sinker 2 staying in the state shown in FIG. 11(A) wherein the terry yarn 7 and the ground yarn 6 are held together on the same hook, sinker hook 2*c*, of the sinker 2, and the ordinary short sinker loop is formed.

As mentioned in the above, in the present invention, when the sinker selector jack 3 is moved selectively by the solenoid actuator 8, terry patterning is carried out, forming the pile knitting portions and ordinary plain knitting portions.

Figure 12:
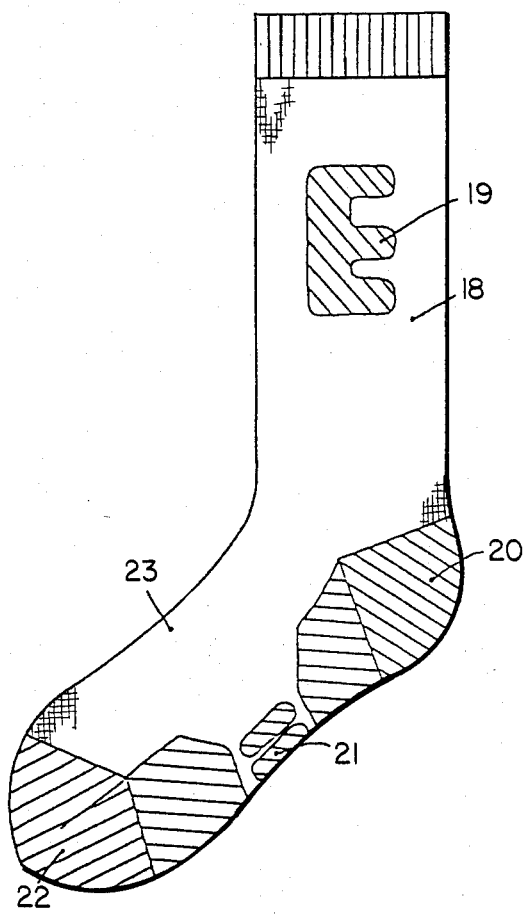
FIG. 12 is a plan view showing an example of hosiery knitted in accordance with the present invention.

FIG. 12 is a plan view showing a sock as an example of hosiery knitted in accordance with the principles of the present invention. A pattern section 19, heel section 20, foot section 21, and toe section 21, which are marked with slant lines, are formed with pile (terry) knitting; while the leg section 18 and instep section 23 are formed with ordinary plain stitches.

Figure 13:
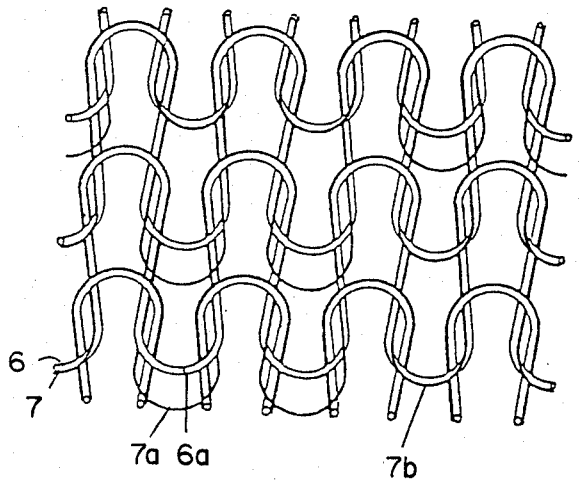
FIG. 13 diagrammatically shows the structure of stitches of a patterned knitting.

FIG. 13 shows a knitting structure of a patterned pile knitting formed with ground yarn 6 and terry yarn 7. In this structure, long sinker loops 7*a* of the terry yarn 7 stitches form the piles (terry). The portions 7*b* where the sinker loops are relatively short form the plain stitches.

The present invention, as described above, provides the sinker patterning that is completely different from the method employed in the prior art. The improved manner in accordance with this invention is simple in structure for individually selecting the sinker movement. The invention is also featured in that it becomes possible to meet the high speed rotation of the knitting machine, eliminating the disadvantage in the conventional method in sinker selection patterning.

While the invention is particularly shown and described with reference to pile (terry) patterning, it should be understood that the same principles can be applied to a reversed knit patterning performed by reversing the face yarn and the back yarn by a sinker having modified shapes in the pile hook 2*b* and the sinker hook 2*c*.

I claim:

1. A circular knitting machine designed to form patterns with sinkers, said knitting machine comprising:

a cylinder provided with vertical slits on its outer circumference;

a sinker mounted in the upper part of every other slit, each one of said sinkers, disposed radially from the axis of the cylinder, being formed on its bottom edge with a cutout having a slanted front edge of the sinker;

a sinker selector jack provided in the slit such that when said sinker selector jack moves up within said slit, said sinker selector jack pushes against said slanted front edge of said cutout of said sinker to move said sinker towards a center of said cylinder; and knitting needles mounted in the slits of the cylinders, each of said needles being in a slit next to the slit wherein the sinker is mounted.

* * * * *